United States Patent [19]

Takayanagi

[11] Patent Number: 4,654,628

[45] Date of Patent: Mar. 31, 1987

[54] NETWORK RESISTOR UNIT

[75] Inventor: Katsumi Takayanagi, Miyagi, Japan

[73] Assignee: Alps Electric Co., Ltd., Japan

[21] Appl. No.: 835,455

[22] Filed: Mar. 3, 1986

[30] Foreign Application Priority Data

Mar. 1, 1985 [JP] Japan ..... 60-28005[U]

[51] Int. Cl.[4] ..... H01C 1/01

[52] U.S. Cl. ..... 338/320; 338/325; 338/329; 361/220

[58] Field of Search ..... 338/320, 319, 324, 325, 338/334, 329; 361/212, 220

[56] References Cited

U.S. PATENT DOCUMENTS 4,179,178 12/1979 Bachman et al. ..... 361/220 X 4,458,291 7/1984 Yanagisawa et al. ..... 361/220 X

*Primary Examiner*—C. L. Albritton

*Attorney, Agent, or Firm*—Guy W. Shoup

[57] ABSTRACT

A discharge terminal is provided integral with a resistor network unit to provide a discharge path for high voltage static electricity so that the high voltage spike does not alter the present values of resistance within the newtwork unit.

The discharge terminal is located near a lead terminal to define a discharge gap between the lead terminal and the discharge terminal such that a static spike will not reach resistive elements in the resistor network.

4 Claims, 4 Drawing Figures

NETWORK RESISTOR UNIT

BACKGROUND OF THE INVENTION

1. Field of the Invention

This invention relates to a network resistor unit suitable for use as a protection device for integrated circuit (IC) parts.

2. Description of the Prior Art

IC parts are being used increasingly as circuit-integration of electronic circuits and down-sizing of electronic equipments progresses. These IC parts are generally used together with protection resistors provided on the input side thereof as a countermeasure against static electricity, because the IC's can be destroyed easily by high voltage spikes such as static electricity from a human body, for example.

FIG. 4 is a sectional view of a conventional network resistor unit used as a protection resistor for IC parts as above, in which reference numeral 1 indicates a substrate, 2 indicates resistance films, 3 indicates electrodes, 4 indicates a common electrode, 5 indicates lead terminals, and 6 indicates a sheath.

In this drawing, a plurality of electrodes 3 and one common electrode 4 are formed on the substrate 1 made of an insulating material, such as ceramics or a phenol resin, and the resistance films 2 of certain width are formed with a certain spacing left therebetween so as to bridge each electrode 3 to the common electrode 4. These resistance films 2 are formed on the substrate 1 by the use of thick-film technique or thin-film technique and then set so as to have a desired resistance value by trimming. The common electrode 4 and respective electrodes 3 have corresponding lead terminals 5 secured by soldering, and the foregoing substrate 1, resistance films 2, electrodes 3 and 4, and lead terminals 5 are sealed by the sheath (casing) 6, except for a protruding portion of each lead terminal 5.

The thus produced network resistor unit is used as a protection resistor for IC parts (not shown) by soldering and securing the respective lead terminals 5 to a print-circuit board (not shown) which connects the resistive elements 2 to respective IC lead terminals and the common electrode 4 to a constant voltage point such as V+ or ground.

The foregoing conventional network resistor unit, however, became defective when static electricity of very high voltage was applied to some lead terminal 5 of the network resistor unit, because the resistance value of the resistance film 2 was permanently altered by the high voltage surge and thereafter it did not perform as a protection resistor of the desired resistance value.

SUMMARY OF THE INVENTION

It is an object of the present invention to provide a network resistor unit which is free from the foregoing drawback of the prior art and minimize variations of resistance due to application of a high voltage.

To achieve the foregoing object, the present invention provides a network resistor unit wherein at least one gap-discharge terminal is provided in a sealing sheath spaced near lead terminals so as to project outside the sheath and provide an electric discharge path between the lead terminals and external discharge connection so that high voltage is not applied across respective resistance elements connected to the lead terminals.

DESCRIPTION OF THE PREFERRED EMBODIMENTS

Embodiments of the present invention will now be described with reference to the drawings.

Figure 1:
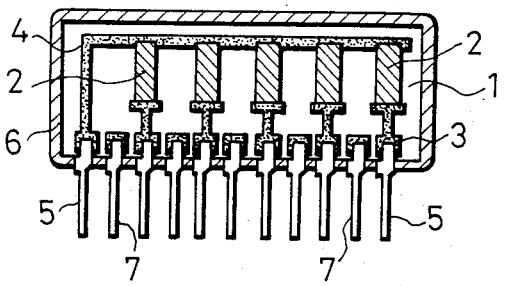
FIG. 1 is a sectional view showing the inner configuration of the first embodiment of a network resistor unit according to the present invention.
Figure 4:
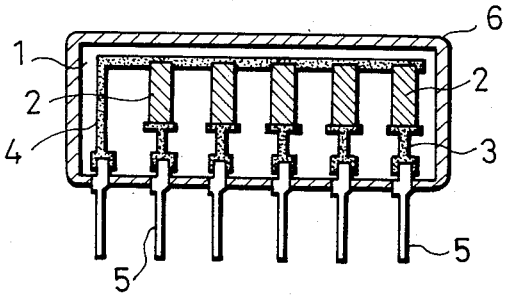
Fig.4 PRIOR ART
FIG. 4 is a sectional view showing the inner configuration of a conventional network resistor unit.

FIG. 1 is a sectional view showing the inner configuration of the first embodiment of a network resistor unit according to the present invention, in which reference numeral 7 indicates gap-discharge terminals, with remaining portions corresponding to those of FIG. 4 being designated by the same reference numerals as those of FIG. 4.

In FIG. 1, similarly to the conventional unit described above, on a substrate 1 made of ceramics, for example, there are pattern-formed a plurality of resistance films 2, corrresponding plural electrodes 3 and one common electrode 4. Lead terminals 5 are soldered and secured to respective ends of the electrodes 3 and 4. Further, a plurality of gap-discharge terminals 7 are positioned between corresponding lead terminals 5 at the lower end of the substrate 1 and soldered and secured there. Each discharge terminal 7 is spaced to form a pair with a corresponding lead terminal 5 and a discharge gap is defined therebetween.

After each resistance film 2 is set to a given resistance value by trimming, there substrate 1, resistance films 2, electrodes 3 and 4, lead terminals 5, and discharge terminals 7 are sealed in a sheath 6, except for a protruding part of each lead terminal 5 and discharge terminals 7. By the foregoing process of manufacture there results a network resistor unit of the SIP (single-in-line package) type wherein the lead terminals 5 and discharge terminals 7 arranged alternately in one row are projecting from the lower end of the sheath 6.

To use the thus produced network resistor unit as a protection resistor of IC parts, each of the lead terminals 5 and discharge terminals 7 is soldered and secured to a print-circuit board (not shown), that is, the lead terminals 5 are connected to the input side of the IC and the discharge terminals 7 are connected to a ground plane on the circuit board. By the foregoing configuration and connection, if an abnormally high static voltage enters unexpectedly into any lead terminal 5 an electric spark occurs between that lead terminal 5 and mating discharge terminal 7, whereby the high voltage surge can be prevented from being applied to the corresponding resistance film 2.

Figure 2:
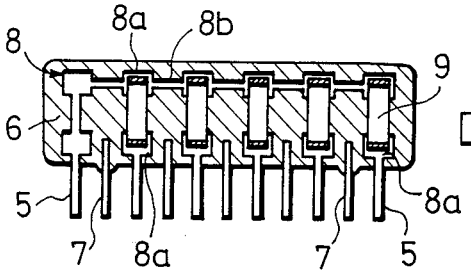
FIG. 2 is a sectional view showing the inner configuration of the second embodiment of the network resistor unit according to the present invention.
Figure 3:
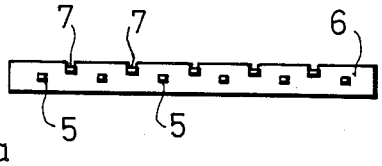
FIG. 3 is a bottom view of the network resistor unit shown in FIG. 2.

FIG. 2 is the sectional view showing the inner configuration of a second embodiment of the network resistor unit according to the present invention, and FIG. 3 is the bottom view of the network resistor unit shown in FIG. 2. In these drawings, reference numeral 8 indicates a substrate, **8*a* indicates supporting portions, 8*b* indicates coupling portions, and 9 indicates chip resistance bodies, with portions corresponding to those of FIG. 1** being designated by the same reference numerals as those of FIG. 1.

In these drawings, the substrate 8 is formed from an integral metal frame of hoop material so that it is easily mass produced by press working, this substrate 8 is formed to have supporting portions 8*a* arranged in upper and lower rows and thinner coupling portions 8*b* inter-connecting together the respective supporting portions 8*a* and bodies 9 are bonded and secured between desired supporting portions 8*a* of respective vertical pairs, except for the left-hand end pair and the coupling portions 8*b* beneath them are removed. The lead terminals 5 and corresponding supporting portions 8*a* of the lower row are formed integrally, and these lead terminals 5 and substrate 8 are prepared and formed by pressworking from a thin strip of hool material. The discharge terminals 7 are partly embeded in the sheath 6 when it is molded, to be spaced near the lead terminals as is the case of the foregoing first embodiment, with the remaining portion each of the discharge terminals projecting between the corresponding lead terminals 5. In this embodiment, as shown clearly in FIG. 3, the row of lead terminals 5 is off-set from that of the discharge terminals 7.

The manner of using the thus produced network resistor unit as a protection resistor is identical to the case of the foregoing first embodiment; thus, no further explanation is given.

As is apparent from the foregoing description, according to the present invention, the lead terminals and discharge terminals are provided in the sheath so as to form a predetermined discharge gap therebetween. Thus, the present invention provides a network resistor unit of superior property which, when an abnormally high static voltage is applied, can prevent such a high voltage from being applied to the resistance elements, thus avoiding the undesirable result that the resistance value lowers due to a high voltage and the drawback of the prior technique. Accordingly, protection against high voltage static spikes is provided as an integral function of the network resistor unit. While the discharge gap described above is formed having a predetermined spacing across air on the sheath material (plastic), it is also within the scope of the present invention to form a discharge gap having a predetermined breakdown voltage by using insulating materials having known breakdown voltages such as certain metal oxides and other materials as shall occur to those skilled in the art in accordance with the spirit of the present invention.

What is claimed is:

1. An improved network resistor unit of the type wherein a plurality of resistance elements are provided on a substrate, said resistance elements and said substrate are sealed in a sheath made of synthetic resin, and a plurality of lead terminals connected respectively to said resistance elements are projecting from said sheath, the improvement comprising at least one discharge terminal provided projecting from said sheath, and defining a discharge gap between said discharge terminal and one of said lead terminals such that a high voltage discharge path is provided away from said resistance elements.

2. A network resistor unit according to claim 1 having a corresponding discharge terminal for each lead terminal, wherein said lead terminals and said discharge terminals are projected alternative from the lower end of said sheath so as to form one row.

3. A network resistor unit according to claim 1, wherein upper and lower ends of each of said resistance elements sealed in said sheath are supported by a corresponding pair of opposed supporting portions made of metal plate, each of said supporting portions on the lower side is formed integrally with a corresponding lead terminal, the supporting portions on the upper side are formed integrally with coupling portions which form one common lead connection to each of said resistance elements.

4. A network resistor unit according to claim 1, wherein said lead terminals are arranged in a first row which is off-set from a second row of discharge terminals.

* * * * *